US006231690B1

(12) United States Patent
Azuma

(10) Patent No.: US 6,231,690 B1
(45) Date of Patent: May 15, 2001

(54) METHOD OF OXIDIZING INNER SURFACE OF FERRITIC STAINLESS PIPE

(76) Inventor: Sigeki Azuma, 14-20-504, Higashimachi 1-chome, Nishinomiya-shi, Hyogo 662-0899 (JP)

( * ) Notice: Subject to any disclaimer, the term of this patent is extended or adjusted under 35 U.S.C. 154(b) by 0 days.

(21) Appl. No.: 09/466,884

(22) Filed: Dec. 20, 1999

Related U.S. Application Data

(63) Continuation of application No. PCT/JP98/02791, filed on Jun. 22, 1998.

(30) Foreign Application Priority Data

Jun. 30, 1997 (JP) ..... 9-173323

(51) Int. Cl.[7] ..... C23C 8/10

(52) U.S. Cl. ..... 148/287; 148/519; 148/591; 148/592; 427/255.22; 427/255.5

(58) Field of Search ..... 148/590, 591, 148/592, 594, 287, 284, 519; 427/255.22, 255.4, 255.5; 428/472.1

(56) References Cited

FOREIGN PATENT DOCUMENTS 48-74434 10/1973 (JP) .
2-43353 2/1990 (JP) .
3-111552 5/1991 (JP) .
7-62520 3/1994 (JP) .
6-116632 4/1994 (JP) .
7-180001 7/1995 (JP) .
7-197206 8/1995 (JP) .
7-233476 9/1995 (JP) .
8-302448 11/1996 (JP) .

OTHER PUBLICATIONS

"Non–corrosive, Non–catalytic Cr2O3 Stainless Steel Piping Technique for Special Gases", the 24th ULSI Ultra Clean Workshop Proceedings, p 55–67; Jun. 5, 1993; sponsored by Institute of Basic Semiconductor Technology Development.

*Primary Examiner*—Roy King
*Assistant Examiner*—Andrew L. Oltmans

(57) ABSTRACT

A method of oxidation treatment of the inner surface of a ferritic stainless steel pipe comprising feeding an oxidizing gas into steel pipe from one end thereof while moving the steel pipe in a pipe-length direction, and heating the pipe in a heating furnace in a non-oxidizing atmosphere at a specific temperature of T° C. which falls within the range of 700–1100° C. The method is capable of efficiently forming Cr oxide film having a uniform Cr content and film thickness over the entire length of the inner surface of the steel pipe used as a piping member or piping for supplying a high-purity fluid, such as high-purity gas or water used in a semiconductor manufacturing process.

22 Claims, 1 Drawing Sheet

METHOD OF OXIDIZING INNER SURFACE OF FERRITIC STAINLESS PIPE

This application is a continuation of international application PCT/JP98/02791 filed on Jun. 22, 1998.

TECHNICAL FIELD

The present invention relates to a method of oxidation treatment of the inner surface of a ferritic stainless steel pipe (hereinafter may be called "inner surface oxidation treatment"). More particularly, the invention relates to a method of oxidation treatment of the inner surface of a ferritic stainless steel pipe used as a piping member or as piping for supplying a high-purity fluid, such as high-purity gas or water used in a semiconductor manufacturing process.

BACKGROUND ART

In the semiconductor manufacturing industry, considerable progress has been made in development of higher-level integration of devices. Particularly, in manufacture of ULSIs, fine patterns of 1 $\mu$m or less are demanded.

During the ULSI manufacturing process, adhesion of fine dusts or a trace amount of impurity ions to wiring patterns may cause a circuitry problem such as a short circuit, resulting in lower yield of the product (i.e., the ULSI device). Therefore, fluid such as gas or water used in the ULSI manufacturing process must be of high purity. In other words, the amount of particles or impurities in the fluid must be very small. Accordingly, when piping or a piping member (hereinafter may be referred to as "piping") is used to supply the high-purity fluid, release of particles, molecules, ions, or impurities from the inner surface thereof—the surface with which the fluid comes in contact—must be suppressed to the extent possible.

Typical materials of the above-described piping include austenitic stainless steel, inter alia, SUS316L. Depending on the specific application, austenitic-ferritic dual phase stainless steel and ferritic stainless steel may also be used.

The inner surface of a stainless steel pipe used for the above-described purposes is smoothed so as to prevent generation of dusts and so as to prevent impurities from adhering to or being absorbed onto the inner surface. Specifically, the inner surface undergoes cold drawing or electro-polishing so as to reduce to the extent possible the surface area which comes into contact with the high-purity fluid.

However, when the high-purity fluid is a corrosive gas such as chlorine gas, hydrogen chloride gas, or hydrogen bromide gas, or a chemically unstable gas such as a silane gas; in other words, when the high-purity fluid is a "special material gas," the inner-surface-smoothing treatment alone is not sufficient. That is, when the special material gas to be employed is a corrosive gas such as chlorine gas, hydrogen chloride gas, or hydrogen bromide gas, the stainless steel pipe must be corrosion resistant. In contrast, when a chemically unstable gas such as a silane gas is used as the special material gas, the stainless steel pipe must have non-catalytic characteristics (in other words, the pipe must not exhibit catalytic properties which decompose the gas into a fine particulate substance when the inner surface of the pipe comes into contact with, for example, a silane gas).

It has been reported that such properties can be improved by heating stainless steel in an atmosphere adjusted to have a low oxygen partial pressure to thereby form Cr oxide film on the surface of the stainless steel (see "Non-corrosive, Non-catalytic $Cr_2O_3$ Stainless Steel Piping Technique for Special Gases," the 24th ULSI Ultra Clean Technology Workshop Proceedings, p. 55–67; Jun. 5, 1993; sponsored by Institute of Basic Semiconductor Technology Development). Since the steel referred to in this article contains about 15 at. % Cr and about 15 at. % Ni, it is austenitic stainless steel, and is presumably SUS316L.

Japanese Patent Application Laid-Open (kokai) Nos. 7-197206 and 7-233476 disclose methods of forming Cr oxide film on the surface of a stainless steel. Specifically, kokai publication No. 7-197206 discloses a method of forming Cr oxide film on the surface of a dual phase stainless steel having a heavily deformed microcrystalline zone, and kokai publication No. 7-233476 discloses a method of forming Cr oxide film on the surface of a ferritic stainless steel. In addition, Japanese Patent Application Laid-Open (kokai) No. 8-302448 discloses a method in which Cr oxide film is formed on the surface of a ferritic stainless steel such that the film has a thickness of 7–50 nm and the grains thereof, which contain Cr in an amount of 90 at. % or more based on the total amount of the constituent elements other than oxygen, have a diameter of 200 nm or less.

However, neither of these publications discloses a method for forming Cr oxide film on the inner surface of a stainless steel pipe which has a length as long as four meters and which is often used as a piping member in a semiconductor manufacturing process, such that Cr content and film thickness are uniform over the entire length of the inner surface.

Japanese Patent Application Laid-Open (kokal) Nos. 2-43353 and 3-111552 disclose techniques for forming oxide film on the inner surface of a stainless steel pipe. Specifically, kokai publication No. 2-43353 discloses a metal oxidation apparatus and a metal oxidation method, and kokai publication No. 3-111552 discloses an apparatus for oxidation treatment of metallic pipe. The techniques disclosed in these publications are of batch-type processing, in which steel pipe is heated from the outer surface while the pipe is secured in a heating furnace and a gas having a specific composition is fed through the steel pipe so as to oxidize the inner surface of the steel pipe in a specific atmosphere at a specific temperature.

When a stainless steel pipe having, for example, a diameter of 6.35 mm and a length of 4 m, which are the dimensions of a piping member often used in a semiconductor manufacturing process, is oxidized by the batch-type processing method, the process is cumbersome and has very poor efficiency. Specifically, the following steps must be repeated for each batch: a steel pipe to be treated is placed in a heating furnace; an inert gas is fed into the pipe in order to purge residual air from the pipe and heating furnace; the pipe is heated for removal of moisture from its inner surface (a so-called baking treatment); supply of the inert gas used for purging the residual air in the steel pipe is switched to supply of a gas for oxidation treatment; and the heating furnace is operated in order to heat the steel pipe for oxidation, after which the furnace is cooled and the steel pipe is removed from the furnace.

In order to improve the efficiency of the batch-type processing and to perform the oxidation treatment on a plurality of steel pipes at one time, the capacity of the heating furnace must be increased. Additionally, in order to heat a plurality of the steel pipes uniformly, a control device must be installed in the heating furnace. Accordingly, the cost of the equipment increases, which results in problems in terms of economy. In addition, in the batch-type processing, only the longitudinal central portion of a steel pipe is heated uniformly. In order to heat a steel pipe as long as 4 m along its entire length, the heating furnace must have a very large capacity and a very long steel pipe holder, which again results in problems in terms of economy.

Moreover, the conventional batch-type processing fails to provide Cr oxide film having a uniform Cr content and uniform thickness along the entire length of the steel pipe. This is because oxidation reaction occurs simultaneously along the entire length of the pipe; one end of the pipe from which an oxidizing gas is fed is most likely to be oxidized, while the other end from which the oxidizing gas is discharged is difficult to oxidize, resulting in a nonuniform Cr oxide film. The gas-exit end is not easily oxidized, because the concentration of the oxidizing substance; i.e., steam and oxygen in an oxidizing gas, becomes low at the gas exit end as compared to the feeding end.

In the heat treatment, another technique is used, in which steel pipes are moved so that the heat treatment is performed on the steel pipe in a continuous process. A technique of such continuous heat treatment applied to stainless steel pipes is generally known as bright annealing. In the case of bright annealing, the heat treatment is performed such that a metallic luster of stainless steel pipe is maintained while oxidation of both the inner and outer surfaces of stainless steel pipe is prevented. Bright annealing is conducted in order to remove the skewness of steel pipe caused by cold working such as cold drawing and to recrystallize the structure of the metal.

Bright annealing can be performed in a reducing atmosphere while the pipe is moved in a pipe-length direction. In this case, a reducing gas, such as hydrogen gas or a mixture of an inert gas and hydrogen gas, is fed into the inside of the steel pipe, while the pipe is moved in a pipe-length direction and inserted into a heating furnace whose atmosphere is also controlled to contain a reducing gas. In the case of the bright annealing, measures are taken to prevent oxidation of both the inner and outer surfaces of the steel pipe. Thus, both the inner and outer surfaces of the stainless steel pipe are exposed to the reducing gas atmosphere. Mixing the gas applied to the inner surface of the pipe with the gas applied to the outer surface presents no problem.

However, in the case of stainless steel pipe used in a semiconductor manufacturing process, only the inner surface of the pipe must be oxidized. Therefore, the above-described continuous method of bright annealing cannot be applied to oxidization of the inner surface of the stainless steel pipe used in a semiconductor manufacturing process.

DISCLOSURE OF THE INVENTION

An object of the present invention is to provide a method of oxidation treatment for the inner surface of a ferritic stainless steel pipe which is used as piping or a piping member for supplying high-purity fluid such as gas or water used in semiconductor manufacturing process; particularly, a method of the oxidation treatment in which Cr oxide film is formed with high efficiency on the inner surface of the ferritic stainless steel pipe used as a pipe or piping member such that the Cr content and the film thickness of Cr oxide film are uniform over the entire length of the pipe.

The gist of the invention will be described below.

The present invention provides a method of oxidation treatment of the inner surface of a ferritic stainless steel pipe comprising feeding an oxidizing gas into steel pipe from one end thereof while moving the steel pipe in a pipe-length direction, and heating the pipe in a heating furnace in a non-oxidizing atmosphere at a specific temperature of T° C. which falls within the range of 700 to 1100° C., to thereby form Cr oxide film on the inner surface of the steel pipe.

The oxidizing gas according to the present invention refers to a mixed gas containing 10 to 99.9999 volume % hydrogen gas, 1 to 300 volume ppm steam, and the balance consisting of an inert gas. The non-oxidizing atmosphere refers to an atmosphere comprising 3 volume ppm or less oxygen and 30 volume ppm or less steam, or a vacuum atmosphere in which the pressure of residual gas is 5 Pa or less.

BEST MODE FOR CARRYING OUT THE INVENTION

Figure 1:
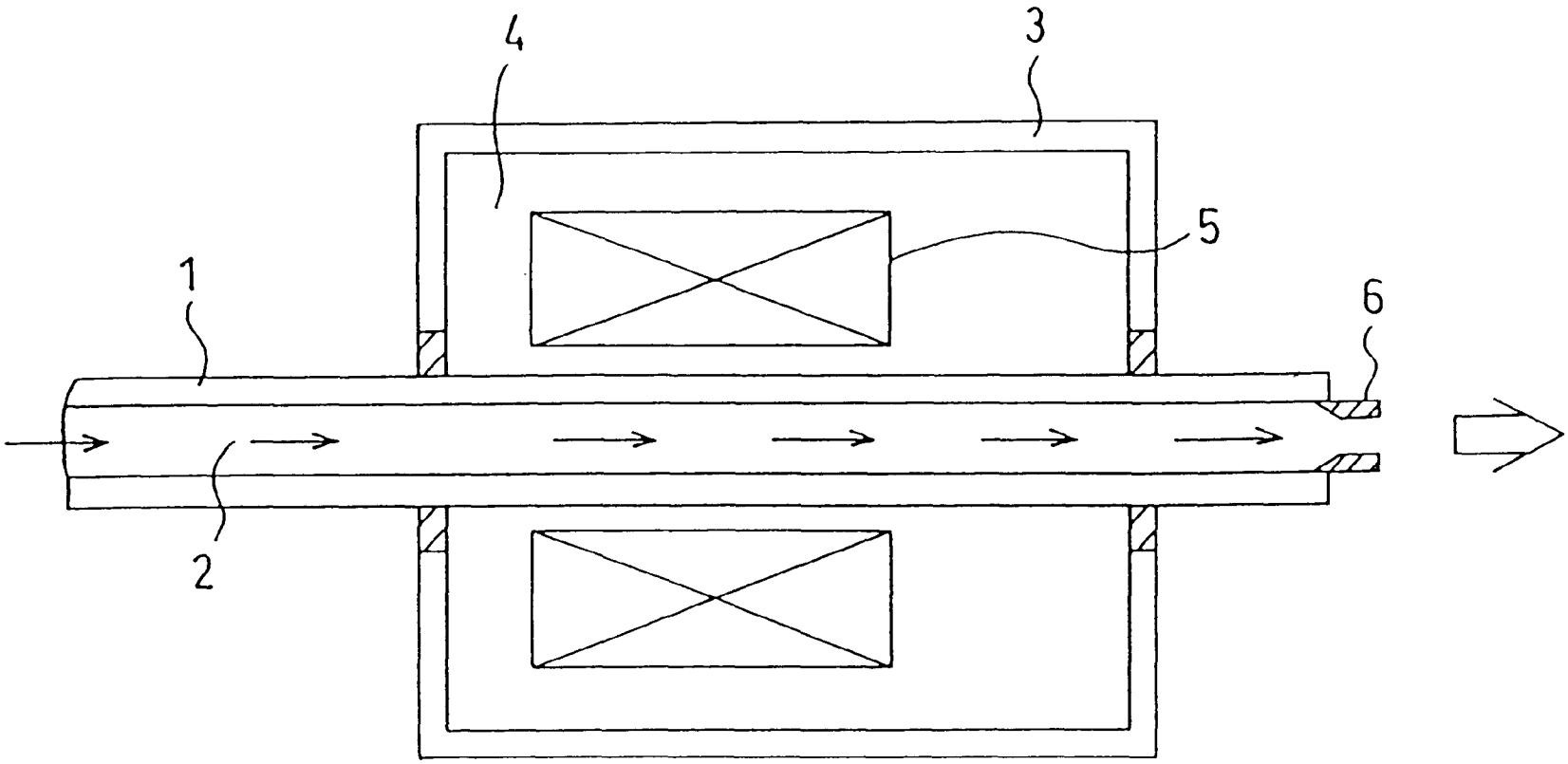
FIG. 1 is an exemplary diagram for carrying out the method of the inner surface oxidation treatment for ferritic stainless steels according to the present invention.

In order to establish a continuous inner surface oxidation technique in which Cr oxide film is formed with high efficiency on the inner surface of a stainless steel pipe of 4-m length such that the Cr oxide film has a uniform film thickness and Cr content is uniform along the entire length of the steel pipe, the inventors have conducted various studies on the factors affecting the oxidation treatment; for example, the material of the stainless steel pipe, the oxidizing atmosphere, the heating temperature, and the conditions for moving the steel pipe. As a result, the inventors have found the following.

(a) When the oxidizing gas is fed into a stainless steel pipe from one end thereof, and at the same time the steel pipe is moved in a pipe-length direction and heated in a heating furnace having a reducing atmosphere, only the inner surface of the steel pipe is oxidized uniformly. In this case, the atmosphere of the inside of the steel pipe must be isolated from that of the outside of the steel pipe. In other words, measures must be taken to prevent mixing of the gas applied to the inside of the pipe with the gas applied to the outside.

(b) In view of the above-described (a), especially in the case of a steel pipe having a large diameter, when a component having an orifice of a small diameter (for example, an inner diameter of less than 10 mm) is attached to one end of the pipe opposite the oxidizing gas feeding end, the outside atmosphere of the steel pipe may be prevented from flowing into the interior of the pipe. Moreover, when dummy steel pipes are attached to both ends of the steel pipe such that the ends of the dummy pipes extend outside of the heating furnace, the inside atmosphere is completely isolated from the outside atmosphere of the steel pipe, and never mixed.

(c) When the oxidizing gas which is fed into the stainless steel pipe contains steam, hydrogen gas, and an inert gas in suitable amounts, the Cr oxide film can be formed on the inner surface of the long stainless steel pipe such that the Cr oxide film has a uniform thickness and uniform Cr content along the entire length of the steel pipe.

(d) In order to form the Cr oxide film on the inner surface of the long stainless steel pipe such that the Cr oxide film has a uniform thickness and uniform Cr content along the entire length of the steel pipe, the flow rate Q (liter/min) of the oxidizing gas fed into the stainless steel pipe is preferably not less than the value determined by $Q=\{7.24(DL/t)\}/C$, wherein D represents the inside diameter (cm) of the steel pipe; L represents the length (cm) of the region having a temperature of T±10° C. in the heating furnace (T represents the heating temperature, as described above); C represents the concentration of steam (volume ppm) contained in the oxidizing gas; and t represents the time (minutes) required for a longitudinal point on the steel pipe to pass through the length L of the region having the above-described heating temperature in the heating furnace (hereinafter called the "processing time").

(e) When stainless steel is subjected to the heat treatment, $Cr_{23}C_6$ precipitates, resulting in deterioration of corrosion resistance. However, when the heat treatment is performed at high temperature, Cr carbides such as $Cr_{23}C_6$ are dissolved easily in steel and corrosion resistance does not lower. In addition, Cr content of the Cr oxide film can be increased steadily.

(f) The formation of the Cr oxide film is governed by the diffusion rate of Cr that diffuses from the inside of the stainless steel to the inner surface portion. The diffusion rate of Cr is higher in ferritic phase than in austenitic phase. In the case of the ferritic stainless steel pipe, when the heating temperature T° C. is set to 700° C. or more, Cr carbides such as $Cr_{23}C_6$ do not precipitate during the heat treatment process, and the Cr oxide film having a high Cr content is efficiently formed on the inner surface of the steel pipe.

(g) When the Cr oxide film contains Cr in an amount of more than 90 at. % based on the total amount of the constituent elements other than oxygen, and the Cr oxide film has a thickness of 10 to 100 nm, the film has corrosion resistance to corrosive gases, such as chlorine gas, hydrogen chloride gas, and hydrogen bromide gas; and the film does not act as a catalyst, so that chemically unstable gases such as silane and so on are not decomposed. When the Cr oxide film contains Cr in an amount of 95 at. % or more, the film has excellent corrosion resistance to corrosive gases and non-catalytic characteristics.

The present invention has been accomplished on the basis of the above findings.

The present invention will next be described in detail with reference to the drawings.

FIG. 1 shows one embodiment for carrying out the inner surface oxidization treatment of a ferritic stainless steel pipe according to the present invention. An oxidizing gas 2 is fed into a ferritic stainless steel pipe 1 from one end of the pipe. While the gas is discharged from the other end, the stainless steel pipe 1 is moved in a pipe-length direction and inserted in a heating furnace 3 having a non-oxidizing atmosphere 4. Subsequently, the stainless steel pipe 1 is heated by use of a heater 5, and thus the inner surface of the pipe is oxidized, to thereby form Cr oxide film on the inner surface of the steel pipe 1.

As shown in FIG. 1, the steel pipe 1 has a component 6 having an orifice at one end opposite the end from which the oxidizing gas 2 is fed, so as to prevent the atmosphere outside the steel pipe from flowing into the inside of the pipe.

Moreover, when dummy steel pipes are attached to both ends of the steel pipe such that the gas outlet end of the dummy steel pipe extends outside the heating furnace, there can be prevented mixing of the inside atmosphere of the steel pipe with the outside atmosphere of the pipe; i.e., the atmosphere in the heating furnace.

(A) Stainless steel pipe which can undergo the inner surface oxidation treatment In order to perform the thermal oxidation treatment of the inner surface of a steel pipe such that Cr carbides such as $Cr_{23}C_6$ do not precipitate during the process, and to effectively form Cr oxide film having a high Cr content on the inner surface of the steel pipe, the present invention must be applied to ferritic stainless steel. This is because formation of the Cr oxide film depends on the diffusion rate of Cr from the inside of the stainless steel to the surface of the steel. The diffusion rate of Cr is faster in the ferritic phase, and therefore the Cr oxide film having a high Cr content is easily formed within a short time in the ferritic stainless steel. In contrast, when a stainless steel contains an austenitic phase, Cr diffuses slowly in the austenitic phase, and the oxidation rate is limited because of the austenitic phase. Therefore, in an austenitic stainless steel or a ferritic-austenitic dual phase stainless steel which contains an austenitic phase, Cr oxide film having a high Cr content cannot be formed within a short period of time as required.

When the austenitic stainless steel or the dual phase stainless steel is used, the stainless steel must be subjected to oxidation treatment of a longer period of time at high temperature in order to increase Cr content in Cr oxide film. As a result, the efficiency of the processing lowers, as is the case with batch-type processing. Therefore, the method of the present invention must be applied to ferritic stainless steel.

The following ferritic stainless steel is preferable as the material for a pipe on the inner surface of which the Cr oxide film is formed by means of the method of the oxidation treatment according to the present invention.

The ferritic stainless steel comprises, by weight, up to 0.03% carbon, up to 0.5% silicon, up to 0.2% manganese, up to 5% nickel, 20 to 30% chromium, and 0.1 to 5% molybdenum; and if necessary, further comprises up to 1% copper, up to 5% tungsten, up to 0.05% aluminum, up to 1% titanium, up to 1% zirconium, up to 1% niobium, up to 0.01% boron, up to 0.01% calcium, up to 0.01% magnesium, up to 0.01% in total of rare earth elements; and the balance iron and unavoidable impurities comprising up to 0.03% nitrogen, up to 0.03% phosphorus, up to 0.003% sulfur, and up to 0.01% oxygen.

The following are the reasons why the above-described ferritic stainless steel is preferable as the material for the pipe subjected to the oxidation treatment of the present invention. The symbol "%" which indicates the amount of each element, represents weight %.

C: When the C content is in excess of 0.03%, Cr carbides may precipitate in a weld zone, resulting in that corrosion resistance decreases. Therefore, the C content is preferably 0.03% or less, more preferably 0.02% or less.

Si: Si exerts a deoxidation effect; however, Si also forms oxide inclusions in the steel. Therefore, the Si content is preferably 0.5% or less. The Si content is more preferably 0.2% or less.

Mn: Mn exerts a dioxidation effect; however, when the Mn content is in excess of 0.2%, a large amount of impurities are formed in the process of welding. Therefore, the Mn content is preferably 0.2% or less, more preferably 0.1% or less.

Ni: When the Ni content is in excess of 5%, the austenitic phase may be formed in the ferritic stainless steel. Therefore, the Ni content is preferably 5% or less.

Cr: Cr improves corrosion resistance of the stainless steel itself, and Cr is also important in the present invention because Cr facilitates formation of the Cr oxide film. When the Cr content is less than 20%, Cr oxide film may not be sufficiently formed. On the other hand, when the Cr content is in excess of 30%, intermetallic compounds are likely to precipitate, resulting in deterioration of toughness. Therefore, the Cr content is preferably 20 to 30%, more preferably 24 to 30%.

Mo: Mo improves corrosion resistance. In order to improve corrosion resistance to corrosive gas, the Mo content is preferably 0.1% or more. If the Mo content is in excess of 5%, intermetallic compounds are formed, resulting in deterioration in toughness. Therefore, the Mo content is preferably 0.1 to 5%, more preferably 1 to 4%.

The ferritic stainless steel may further contain the following elements if necessary.

Cu: Since Cu improves corrosion resistance, corrosion resistance to corrosive gases is improved. However, when the Cu content is in excess of 1%, intermetallic compounds are formed, resulting in deterioration of toughness. Therefore, the Cu content is preferably 1% or less. In order to obtain the effect of Cu in improvement of corrosion resistance, the Cu content is preferably 0.1 or more, more preferably 0.2 to 0.5%.

W: W has an effect in enhancing corrosion resistance, and therefore W improves corrosion resistance of steel to corrosive gases. However, when the W content is in excess of 5%, intermetallic compounds are formed, resulting in deterioration of toughness. Therefore, W content is preferably 5% or less. In order to obtain the effect of W in improvement of corrosion resistance, the W content is preferably 0.1 or more, more preferably 1 to 4%.

Al: Al forms oxide inclusions in the steel. Also, because Al is easily oxidized, Al forms oxides in the process of welding, resulting in generation of impurities. Therefore, the Al content is preferably 0.05% or less, more preferably 0.01% or less.

Ti: Ti functions to effect stabilization of C and N; however, when the content is in excess of 1%, toughness of the steel may lower. Therefore, Ti content is preferably 1% or less. In order to obtain the effect of Ti in stabilizing C and N, Ti content is preferably 0.05% or more. The Ti content is more preferably 0.05 to 0.20%, particularly preferably 0.07 to 0.15%.

Nb: Nb functions to effect a stabilization of C and N; however, when the Nb content is in excess of 1%, the toughness of the steel may decline. Therefore, the Nb content is preferably 1% or less. In order to obtain the effect of Nb in stabilization of C and N, the Nb content is preferably 0.05% or more. The Nb content is more preferably 0.05 to 0.20%, particularly preferably 0.07 to 0.15%.

Zr: Zr has an effect in stabilizing C and N; however, when the content is in excess of 1%, toughness of the steel may lower. Therefore, the Zr content is preferably 1% or less. In order to obtain the effect of Zr in stabilizing C and N, the content is preferably 0.05% or more. The Zr content is more preferably 0.05 to 0.20%, particularly preferably 0.07 to 0.15%.

B: Since B accelerates precipitation of Cr carbides in the stainless steel, Cr carbides are precipitated during the oxidation process, with the result that the concentration of Cr in the oxide film may become low or nonuniform. Therefore, in the case of the conventional batch-type oxidation processing which requires a relatively longer time to form an oxide film, the B content must be limited to an extremely low level. However, in the case of the oxidation treatment according to the present invention, the oxide film is formed as desired within a short period of time, so that Cr carbides do not precipitate. Therefore, B may be added to the steel in order to utilize the effect in improving hot workability. However, when the B content is in excess of 0.01%, the effect of B is saturated; moreover, even when the oxidation treatment according to the present invention is applied, precipitation of Cr carbides cannot be prevented. Therefore, the B content is preferably 0.01% or less. Also, in order to obtain the effect of B in improving hot workability, the content is preferably 0.0005% or more.

Ca: Ca improves hot workability. When the Ca content is in excess of 0.01%, Ca forms nonmetallic inclusions, resulting in deterioration of surface roughness. Therefore, the Ca content is preferably 0.01% or less. In order to obtain the effect of Ca in improving hot workability, the content is preferably 0.001% or more.

Mg: Mg improves hot workability. When the Mg content is in excess of 0.01%, Mg forms nonmetallic inclusions, resulting in deterioration of surface roughness. Therefore, the Mg content is preferably 0.01% or less. In order to obtain the effect of Mg in improving hot workability, the Mg content is preferably 0.001% or more.

Rare earth elements: They may be present in amounts of 0.01% or less in total. Rare earth elements improve hot workability. When the rare earth element content is in excess of 0.01% in total, the rare earth elements form nonmetallic inclusions, resulting in deterioration of surface roughness. Therefore, the content of the rare earth elements is preferably 0.01% or less in total. In order to obtain the effect of the rare earth elements in improving hot workability, the content of the rare earth elements is preferably 0.001% or more in total.

The amounts of impurities; i.e., N, P, S, and 0 are preferably limited to the following level.

N: In order to prevent formation of Cr nitride and deterioration of toughness, the N content is preferably 0.03% or less, more preferably 0.01% or less.

P: Since P adversely affects hot workability, the P content must be limited to a low level. However, in the case of industrial-scale production, limiting the P content to an extremely low level involves difficulty. Also, in order to produce a stainless steel with a low P content, an expensive raw material must be used, resulting in problems in economy. Therefore, the maximum P content is preferably set to a level which does not affect the performance of the steel. The P content is preferably 0.03% or less, more preferably 0.02% or less.

S: Even a very low level of S content results in formation of sulfide inclusions, which severely affects corrosion resistance. Therefore, the S content is preferably 0.003% or less, more preferably 0.002% or less.

O(Oxygen): When the O content is in excess of 0.01%, impurities are easily formed in the process of welding. Therefore, the O content is preferably 0.01% or less, more preferably 0.005% or less.

(B) Atmosphere in a heating furnace

In order to prevent oxidation of the outer surface of the stainless steel pipe 1, the atmosphere 4 within the heating furnace 3 must be a non-oxidizing atmosphere. The reasons are as follows: when the outer surface of the stainless steel pipe 1 is oxidized, particles flake off from the oxide film and the manufacturing environment is contaminated by the particles; such a pipe having the oxidized outer surface cannot be used in a semiconductor manufacturing process, which requires an extremely high level of cleanness. In order to obtain a non-oxidizing atmosphere 4, the heating furnace 3 is filled with inert gases, such as hydrogen gas and argon gas (however, the concentration of gas must be kept 3 volume ppm or less of oxygen and 30 volume ppm or less of steam);

or the heating furnace 3 must have a vacuum atmosphere with a residual gas pressure of 5 Pa or less. In order to easily and reliably obtain a non-oxidizing atmosphere 4 within the heating furnace for industrial-scale production, hydrogen gas may be used under the above conditions. The hydrogen gas atmosphere in the heating furnace preferably contains 1 volume ppm or less oxygen and 10 volume ppm or less steam.

(C) Heating temperature for stainless steel pipe

The stainless steel pipe 1 must be heated to a specific temperature of T° C. within the range of 700 to 1100° C. The reason why the minimum heating temperature is set at 700° C. is as follows: when the heating temperature is less than 700° C., Cr oxide film is formed slowly; Therefore, in order to obtain a film having a thickness of 10 nm or more, the above-described processing time t must be 60 minutes or more, which is not suitable for industrial-scale production. The reason why the maximum heating temperature is set at 1100° C. is as follows: when the temperature is in excess of 1100° C., the oxidation rate excessively increases, with the result that an non-uniform oxide film may be formed, depending on the composition and flow rate of the oxidizing gas 2.

The minimum temperature for heating the stainless steel pipe 1 is preferably 750° C. When the heating temperature is less than 800° C., Cr carbides may precipitate easily depending on the chemical composition of the stainless steel. Therefore, the minimum heating temperature for the stainless steel pipe 1 is more preferably 800° C. On the other hand, when the heating temperature is in excess of 1000° C., grains may become coarser, depending on the chemical composition of the ferritic stainless steel, resulting in deterioration of ductility and toughness. Therefore, the maximum temperature for heating the stainless steel pipe 1 is preferably 1000° C.

(D) Oxidizing gas introduced into the stainless steel pipe

The oxidizing gas 2 which is introduced into the ferritic stainless steel 1 must contain a mixed gas of 10 to 99.9999 volume % of hydrogen, 1 to 300 volume ppm of steam, and the balance inert gas.

When the hydrogen content is less than 10 volume %, the slightest change in the steam content in the steel pipe 1 during oxidizing reaction affects oxidation behavior significantly. As a result, the Cr oxide film cannot be stably formed such that the film has a high Cr content and a uniform thickness.

When the steam content is less than 1 volume ppm, the Cr oxide film cannot be formed to a sufficient thickness, whereas when the steam content is in excess of 300 volume ppm, the thickness of the Cr oxide film becomes far greater than 100 nm and the inner surface of the steel pipe becomes excessively rough. In order to impart the Cr oxide film with a uniform thickness and high Cr content, the steam content is preferably 5 to 200 volume ppm, more preferably 10 to 100 volume ppm.

In addition to containing hydrogen and steam, the oxidizing gas 2 comprises an inert gas. Examples of such an inert gas include helium gas, argon gas, and neon gas. Among them, argon gas is economically advantageous for use. The hydrogen content and inert gas content in the oxidizing gas 2 can be adjusted by use of a flow control device, and the steam content can be adjusted by use of a dew-point hydrometer and a steam addition device.

In order to form Cr oxide film on the inner surface of the steel pipe 1 with high efficiency such that the film has a uniform Cr content and a uniform thickness along the entire length of the pipe, the oxidizing gas 2 has the above-described composition and the stainless steel pipe 1 is heated at the above-described temperature. In addition, the oxidizing gas 2 is preferably fed into the stainless steel pipe 1 at a flow rate of not less than a specific value which provides a sufficient amount of oxygen into the steel pipe so as to allow the oxidizing gas 2 to serve as an oxygen source for forming an oxide film. In other words, the flow rate of the oxidizing gas 2 fed in the stainless steel pipe 1 is preferably not less than Q, which is obtained by the following expression:

$$Q=\{7.24(DL/t)\}/C \qquad (i)$$

In the above-described expression, Q represents the flow rate of oxidizing gas fed into a piece of stainless steel pipe, and the rate is expressed in units of liter/minute. As has already been described, D represents the inner diameter of the stainless steel pipe 1; L represents the length of the region having a temperature of T±10° C. in the heating furnace 3; t represents the processing time (in other words, the time required for a longitudinal point on the steel pipe to pass through the length L in the heating furnace 3); and C represents the concentration of steam in the oxidizing gas. These items are expressed in units of cm, cm, minute, and volume ppm, respectively.

When the oxidizing gas 2 is fed into the stainless steel pipe 1 at the flow rate of not less than Q as determined by expression (i), a stable oxide ($Cr_2O_3$) film can be easily formed on the inner surface of the pipe such that the film has a thickness of 10 nm or more and contains 95 at. % or more of Cr based on the total amount of the constituent elements other than oxygen. When the flow rate of the oxidizing gas 2 fed into the stainless steel pipe 1 is around 0.6 Q, the rate is still sufficient for forming the $Cr_2O_3$ oxide film such that the film has a thickness of 10 nm or more and contains 90 at. % of Cr based on the total amount of the constituent elements other than oxygen, as described below.

When the flow rate of the oxidizing gas 2 becomes high, the gas used for the oxidation treatment becomes prohibitively expensive. Thus, the flow rate of the oxidizing gas 2 preferably falls within a flow rate of three times Q as obtained by expression (i).

In order to prevent the air or the non-oxidizing gas in the heating furnace from flowing into the inside of the stainless steel pipe 1 from the gas outlet end—the end opposite the gas feeding end from which the oxidizing gas 2 is fed; or, in the case where stainless steel pipes are longitudinally jointed to one another for improving efficiency of the oxidation treatment, to prevent the air or non-oxidizing gas from flowing into the inside of the pipe 1 through the jointed portion of stainless steel pipes, the oxidizing gas 2 is preferably fed at the pressure such that the pressure of the gas in the pipe becomes greater than both atmospheric pressure and the pressure in the heating furnace. Specifically, the oxidizing gas 2 is preferably fed at a pressure of 0.2 kgf/cm$^2$ or more, more preferably 0.5 kgf/cm$^2$ or more. Regarding the pressure inside the steel pipe, when the inside diameter of the steel pipe is small, the pressure inside the steel pipe increases because of resistance inside the pipe. Thus, there is no need for any measure to increase the pressure inside the pipe. On the other hand, when the inside diameter is 1 cm or more, a component having an orifice which has an inner diameter of less than 10 mm is preferably attached to the stainless steel pipe. Therefore, the inside diameter of the end of the pipe becomes smaller and the pressure inside the steel is increased.

Moreover, dummy steel pipes are preferably attached to the stainless steel pipe such that at least the gas outlet end of the dummy pipe extends outside the heating furnace so as to prevent mixing of the atmosphere inside the stainless steel pipe with the atmosphere outside the pipe; i.e., the atmosphere in the furnace.

(E) Processing time t (the time which is required for a longitudinal point on a steel pipe to pass through the length L of the region where the heating furnace has a temperature of T±10° C.)

The processing time t preferably falls within the range of 1 to 60 minutes. When the time t is less than 1 minute, the properties of the oxide film tend to be affected by depressions and projections on the inner surface of the steel pipe, or by crystal orientation. As a result, nonuniform oxide film may be formed. On the other hand, when the processing time t is in excess of 60 minutes, the efficiency of the oxidation treatment lowers; and, depending on the chemical composition of the ferritic stainless steel, Cr carbides may be formed. As a result, the Cr concentration in the Cr oxide film may decrease or become nonuniform.

In the present invention, the oxidizing gas 2 is introduced in the stainless steel pipe 1 from its end, while the stainless steel pipe is longitudinally moved and inserted into the heating furnace 3, to thereby oxidize the inner surface of the steel pipe 1. The steel pipe 1 is longitudinally moved into the heating furnace 3, and as the pipe passes through the region having a length L and a temperature of T±10° C., the oxide film is formed on the inner surface of the pipe. Before the steel pipe 1 is inserted into the heating furnace, the temperature of the steel pipe 1 is set at a temperature such that the oxidizing gas does not react; typically at ambient temperature. Just before the steel pipe 1 whose inner surface is subjected to the oxidation treatment is moved out from the furnace 3, the temperature of the pipe is preferably 300° C. or less, in order to prevent the outer surface of the pipe from being oxidized by the air once the steel pipe is removed from the furnace.

When the inner surface oxidation treatment is conducted by conventional batch-type processing, oxidation reaction simultaneously occurs along the entire length of a steel pipe. In contrast, by the method according to the present invention, the steel pipe 1 is moving during treatment so that oxidation reaction occurs on the portion which is inside the heating furnace 3. Accordingly, as compared with the case of the conventional method, in the method according to the present invention, the inner surface of the pipe 1 can be oxidized by an oxidizing gas with a constant composition, in particular, with no decrease in steam content, thus the film can attain a uniform Cr content and uniform thickness.

According to the method of the present invention, when steel pipes are longitudinally jointed to one another, oxidation treatment can be continuously performed on the inner surface of the steel pipes. In this case, measures must be taken to prevent the outside atmosphere from flowing into the inside the steel pipe through the joints. For this purpose, steel pipes are jointed through welding or by use of metal face seal fitting and W-ferrule compression fitting, or by any other method providing an airtight joint.

EXAMPLES

The present invention will next be described by way of examples, which should not be construed as limiting the invention thereto.

EXAMPLE 1

A ferritic stainless steel having the chemical composition shown in Table 1 was produced in a vacuum melting furnace, to thereby obtain steel ingots.

TABLE 1

| Chemical composition (wt. %) Balance: Fe and impurities | | | | | | | | | | | |
|---|---|---|---|---|---|---|---|---|---|---|---|
| C | Si | Mn | P | S | Ni | Cr | Mo | Al | Nb | N | O |
| 0.008 | 0.02 | 0.01 | 0.016 | 0.001 | 0.02 | 27.12 | 1.32 | 0.005 | 0.09 | 0.005 | 0.004 |

The steel ingots were hot forged and processed into billets, and the billets were hot extruded and processed into seamless steel pipes. The thus-obtained seamless steel pipes were subjected to cold reducing and cold drawing so as to reduce pipe diameter and thickness, to thereby obtain three types of stainless steel pipes having the sizes shown in Table 2. After cold reducing and cold drawing, the stainless steel pipes were heated in a pure hydrogen gas atmosphere by the conventionally-employed method of bright annealing.

TABLE 2

| Outer diameter (cm) | Wall thickness (cm) | Inner diameter (cm) | Length (cm) |
|---|---|---|---|
| 0.635 | 0.10 | 0.435 | 400 |
| 0.953 | 0.10 | 0.753 | 400 |
| 1.27 | 0.11 | 1.050 | 400 |

After completion of bright annealing, the inner surfaces of the stainless steel pipes were subjected to electro-polishing in a conventional manner, and smoothed such that the surface roughness becomes 1 $\mu$m or less in terms of Rmax. Subsequently, the pipes were washed with ultra-pure water, and dried.

Dummy pipes having the same size as the stainless steel pipe were connected to both ends of each steel pipe. The oxidizing gas was fed into from the rear end of the pipe, while the pipe was moved in a pipe-length direction and inserted into a heating furnace. The inner surfaces of the pipes were then subjected to oxidation treatment. Some of the test steel pipes were connected by use of a W-ferrule compression fitting known as "swagelock," so that the pipes were successively subjected to the oxidation process. A part having a 4-mm-diameter orifice was attached to each end of the pipe having an inside diameter of 1.05 cm, to thereby perform the oxidation process.

Table 3 shows the compositions of the oxidizing gas and heating conditions for the inner surface oxidation process.

FIG. 1 shows the arrangement of the heating furnace and the steel pipes used in the oxidation process. The oxidizing gas was fed at a pressure of 2 kgf/cm$^2$. A non-oxidizing atmosphere in the heating furnace was formed from a hydrogen gas containing one volume ppm of oxygen and 10 volume ppm of steam. Test Nos. 1–15 in Table 3 represent examples of the present invention in which the inner surfaces of the steel pipes were subjected to the oxidation process under the conditions specified by the present invention. Test Nos. 16–22 represent comparative examples in which the oxidation process was performed on the inner surface of the steel pipes under conditions which deviate those specified by the present invention.

length of the region where the heating temperature is T±10° C. in the heating furnace. On the other hand, in Test Nos. 21 and 22, the test steel pipes were oxidized in batch-type processing. In the tubular heating furnace, the length of the region having the set temperature ±10° C. was 420 cm, so that the "length of uniform temperature" represents the overall length of the test steel pipes; i.e., 400 cm. Also, in the case of the batch-type processing, the process time t represents the retention time at the set temperature ±10° C.

The properties of oxide film formed on the inner surface of the steel pipes through the oxidation treatment were evaluated as follows:

TABLE 3

| | Inner | Oxidizing gas | | | | | Heating conditions | | |
|---|---|---|---|---|---|---|---|---|---|
| Test No | diameter D (cm) steel pipe of sample | Hydrogen (vol. %) | Argon (vol. %) | Steam (vol. ppm) | Flow rate (L/min) | Flow rate Q as calculated from equation (i) (L/min) | Length of uniform temperature zone, L (cm) | Heating temperature, T (° C.) | Treatment time, t (min) |
| 1 | 0.435 | 30 | 69.988 | 120 | 0.7 | 0.5 | 200 | 850 | 10 |
| 2 | 0.435 | 30 | 69.995 | 50 | 1.5 | 1.3 | 200 | 850 | 10 |
| 3 | 0.435 | 30 | 69.999 | 10 | 7.0 | 6.3 | 200 | 850 | 10 |
| 4 | 0.435 | 99.988 | 0 | 120 | 0.6 | 0.5 | 200 | 850 | 10 |
| 5 | 0.435 | 30 | 69.988 | 120 | 1.2 | 1.0 | 200 | 850 | 5 |
| 6 | 0.435 | 30 | 69.988 | 120 | 0.4 | 0.3 | 200 | 850 | 15 |
| 7 | 0.435 | 30 | 69.988 | 120 | 1.0 | 0.5 | 200 | 760 | 10 |
| 8 | 0.435 | 30 | 69.988 | 120 | 1.2 | 0.5 | 200 | 900 | 10 |
| 9 | 0.435 | 30 | 69.988 | 120 | 0.8 | 0.5 | 200 | 950 | * 10 |
| 10 | 0.435 | 30 | 69.988 | 120 | 0.5 | 0.3 | 100 | 850 | 10 |
| 11 | 0.435 | 30 | 69.988 | 120 | 1.1 | 0.8 | 300 | 850 | 10 |
| 12 | 0.753 | 30 | 69.988 | 120 | 1.3 | 0.9 | 200 | 850 | 10 |
| 13 | 1.05 | 30 | 69.988 | 120 | 1.8 | 1.3 | 200 | 850 | 10 |
| 14 | 0.435 | 30 | 69.988 | 120 | 0.3 | 0.5 | 200 | 850 | 10 |
| 15 | 0.435 | 30 | 69.988 | 120 | 1.0 | 1.3 | 500 | 850 | 10 |
| 16 | 0.435 | 30 | 69.9999 | * 0.6 | 15 | 13.1 | 50 | 850 | 20 |
| 17 | 0.435 | 30 | 69.965 | * 350 | 0.8 | 0.2 | 200 | 850 | 10 |
| 18 | 0.435 | * 5 | 94.988 | 120 | 0.8 | 0.5 | 200 | 850 | 10 |
| 19 | 0.435 | 30 | 69.988 | 120 | 0.8 | 0.5 | 200 | * 650 | 10 |
| 20 | 0.435 | 30 | 69.988 | 120 | 0.8 | 0.5 | 200 | * 1150 | 10 |
| 21 | 0.435 | 30 | 69.988 | 120 | t.2 | 1.1 | 400 | 850 | 10 |
| 22 | 0.435 | 30 | 69.988 | 120 | 1.2 | 0.18 | 400 | * 400 | 60 |

Data marked with * deviate the conditions defined in the present invention.
Test Nos. 21 and 22 are drawn to treatment performed in a conventional batch manner.

Test Nos. 21 and 22 in the comparative examples were drawn to oxidization treatment through conventional batch-type processing. The oxidation treatment according to the batch-type processing was conducted as follows: dummy pipes having a length of 100 cm were connected through welding at both ends of a 400-cm-long steel pipe, to thereby obtain a test steel pipe. The test steel pipe was attached to a quartz furnace tube having a length of 550 cm, and heated in a tubular furnace having a length of 500 cm. In the tubular furnace, the test steel pipe was heated uniformly at the center of a 420 cm long region (the temperature of the region being the set temperature ±10° C.). Table 3 shows the compositions of the oxidizing gas and heating conditions for the oxidation treatment according to the conventional batch-type processing. A non-oxidizing atmosphere in the quartz furnace tube was formed of a hydrogen gas which contained one volume ppm of oxygen and 10 volume ppm of steam in the case of batch-type processing. For each of Test Nos. 21–22, four pipes were processed.

In Test Nos. 1–20 in Table 3, the test steel pipes were moved. The "length of uniform temperature" represents the For each of the Test Nos., samples measuring 3-cm long were obtained from each of the test steel pipes. Portions of a test steel pipe were cut out from the ends, the center, and the regions between the center and the respective ends (total 5 portions), and the thus-cut out portions were then cut in half in a pipe-length direction, to thereby obtain the samples. The Cr oxide film formed on the inner surface of each of the samples was examined through secondary ion mass spectroscopy by $N_2^+$ ion sputtering. Specifically, secondary ion mass spectroscopy was conducted in a depth direction of the oxide film surface, to thereby measure the maximum amount of Cr (the Cr content) based on the total amounts of the major elements; i.e., Cr, Ni, Fe, Mo, Si, and Mn, and the thickness of the film where the Cr concentration was high.

Table 4 shows the results of the evaluation of the properties of oxide films. The Cr content in Table 4 indicates the maximum amount (at. %) of Cr based on the total amount of the major elements; i.e., Cr, Ni, Fe, Mo, Si, and Mn. Regarding the numbering of position, Position 1 represents the end from which the oxidizing gas was fed. The remaining positions are numbered Position 2 to 5, in order from the gas feeding end toward the opposite end.

TABLE 4

| Test No. | Cr content (wt. %) Position 1 | Position 2 | Position 3 | Position 4 | Position 5 | Film thickness (nm) Position 1 | Position 2 | Position 3 | Position 4 | Position 5 |
|---|---|---|---|---|---|---|---|---|---|---|
| 1 | 96 | 98 | 97 | 98 | 99 | 42 | 45 | 42 | 43 | 44 |
| 2 | 98 | 96 | 97 | 99 | 98 | 38 | 39 | 40 | 45 | 40 |
| 3 | 99 | 98 | 98 | 98 | 97 | 32 | 36 | 34 | 35 | 33 |
| 4 | 98 | 97 | 98 | 98 | 96 | 36 | 35 | 36 | 38 | 35 |
| 5 | 98 | 99 | 98 | 99 | 97 | 32 | 33 | 35 | 35 | 31 |
| 6 | 98 | 96 | 98 | 98 | 99 | 45 | 46 | 48 | 45 | 48 |
| 7 | 99 | 98 | 97 | 98 | 98 | 36 | 35 | 38 | 36 | 35 |
| 8 | 98 | 96 | 98 | 97 | 98 | 45 | 46 | 48 | 46 | 44 |
| 9 | 96 | 96 | 96 | 98 | 98 | 44 | 48 | 49 | 50 | 48 |
| 10 | 98 | 97 | 96 | 97 | 98 | 41 | 42 | 43 | 44 | 42 |
| 11 | 98 | 99 | 99 | 98 | 99 | 40 | 42 | 41 | 42 | 40 |
| 12 | 99 | 97 | 99 | 98 | 98 | 41 | 39 | 38 | 39 | 40 |
| 13 | 98 | 97 | 98 | 97 | 99 | 40 | 39 | 38 | 40 | 39 |
| 14 | 92 | 91 | 90 | 92 | 93 | 29 | 27 | 29 | 25 | 24 |
| 15 | 93 | 92 | 92 | 94 | 93 | 21 | 24 | 23 | 22 | 28 |
| 16 | 90 | 88 | 86 | 85 | 88 | 6 | 5 | 5 | 3 | 4 |
| 17 | 91 | 80 | 85 | 84 | 83 | 80 | 86 | 84 | 82 | 83 |
| 18 | 85 | 96 | 84 | 85 | 85 | 56 | 75 | 62 | 60 | 58 |
| 19 | 90 | 92 | 93 | 91 | 93 | 7 | 6 | 3 | 3 | 3 |
| 20 | 86 | 85 | 95 | 86 | 90 | 180 | 120 | 56 | 64 | 104 |
| 21 | 98 | 86 | 72 | 70 | 70 | 41 | 13 | 5 | 3 | 3 |
| 22 | 90 | 85 | 85 | 83 | 75 | 8 | 5 | 3 | 3 | 4 |

As is apparent from Table 4, in Test Nos. 1 to 15 which represent working examples of the present invention, regardless of the size of the test steel pipes and the longitudinal positions of the test steel pipes, the Cr contents were in excess of 90 at. %, and uniform oxide films having a thickness of 21–50 nm were formed. Especially, in Test Nos. 1 to 13, the Cr contents were in excess of 95 at. %, and extremely uniform oxide films having a thickness of 31–50 nm were formed. In contrast, in the comparative examples of Test Nos. 16 to 20 in which one of the oxidization conditions, either the composition of the oxidizing gas (the steam content and the hydrogen content) or the heating temperature, deviates the conditions specified by the present invention, in most cases, the Cr content in the oxide film was less than 90%, and some oxide films had a thickness of less than 10 nm whereas other oxide films had a thickness in excess of 100 nm. In the comparative examples of Test Nos. 21 and 22 in which the conventional batch-type processing was performed, the Cr content in the oxide film and the film thickness varied greatly.

The metallographic microstructure of each steel pipe of the examples of the present invention from Test Nos. 1 to 15 was observed under an optical microscope, and no Cr carbides were detected in the steel pipes.

For each Test No., the 400-cm long test pipes whose inner surfaces had been oxidized were cut to a length of 200 cm, and the following properties of the test pipes were examined.

Moisture release characteristics of the steel pipes were determined as follows. Each of the steel pipes was allowed to stand for 24 hours at 50% humidity in a laboratory room, after which ultra-pure argon gas containing water in an amount of less than one volume ppb was fed into the steel pipe at one liter/minute. Subsequently, reduction in water concentration at the gas outlet end of each pipe was measured under an atmospheric ionization mass spectroscope. The evaluation criterion was the time required for water concentration to decrease to one volume ppb or less after the start of measurement.

Corrosion resistance of the steel pipes was evaluated through observation under a scanning electron microscope. Specifically, hydrogen chloride gas was sealed in the steel pipes at 0.1 atm, and retained therein for 100 hours at 80° C., after which observation was made as to whether or not there was any change on the inner surfaces of the pipes.

Catalytic characteristics of the steel pipes were examined through gas chromatography. Specifically, argon gas containing monosilane ($SiH_4$) in an amount of 100 volume ppm was introduced in the steel pipes, and concentration of $H_2$ which was generated through decomposition of monosilane was measured at the gas outlet end of each pipe. The steel pipes were measured at various temperatures as described above, and evaluated on the basis of the minimum temperature at which monosilane was decomposed.

Table 5 shows the results of the evaluation of properties. As is apparent from Table 5, the results of Test Nos. 1 to 15 which represent examples of the invention exhibit excellent moisture release characteristics, corrosion resistance, and non-catalytic characteristics, as compared with the comparative examples of Test Nos. 16 to 22 (Test Nos. 21 and 22 represent the comparative examples in which the conventional batch-type processing was performed).

TABLE 5

| Test No. | Moisture Dry-down (Note 1) | Corrosion resistance (Note 2) | Catalytic property (Note 3) |
|---|---|---|---|
| 1 | ◎ | ○ | ○ |
| 2 | ◎ | ○ | ○ |
| 3 | ◎ | ○ | ○ |
| 4 | ◎ | ○ | ○ |
| 5 | ◎ | ○ | ○ |
| 6 | ◎ | ○ | ○ |
| 7 | ◎ | ○ | ○ |
| 8 | ◎ | ○ | ○ |
| 9 | ◎ | ○ | ○ |
| 10 | ◎ | ○ | ○ |
| 11 | ◎ | ○ | ○ |
| 12 | ◎ | ○ | ○ |
| 13 | ◎ | ○ | ○ |

TABLE 5-continued

| Test No. | Moisture Dry-down (Note 1) | Corrosion resistance (Note 2) | Catalytic property (Note 3) |
|---|---|---|---|
| 14 | ◎ | ○ | ○ |
| 15 | ◎ | ○ | ○ |
| 16 | x | x | x |
| 17 | ○ | x | ○ |
| 18 | ○ | x | ○ |
| 19 | ○ | x | x |
| 20 | ○ | x | x |
| 21 | x | x | ○ |
| 22 | ○ | x | x |

(Note 1) The time during which the moisture content decreases to 1 vol. ppb is: ◎ less than 6 hours ○ 6 hours or more and less than 12 hours x 12 hours or more TABLE 5-continued

| Test No. | Moisture Dry-down (Note 1) | Corrosion resistance (Note 2) | Catalytic property (Note 3) |
|---|---|---|---|

(Note 2) ○ no corrosion x occurrence of corrosion
(Note 3) The decomposition temperature of monosilane is: ○ 400° C. or higher x lower than 400° C.

EXAMPLE 2

A variety of stainless steels A to F having the corresponding chemical compositions shown in Table 6 were produced in a vacuum melting furnace. The thus-produced steel ingots were hot forged and processed into billets, and the billets were then hot extruded and processed into seamless steel pipes. The thus-obtained seamless steel pipes were subjected to cold reducing and cold drawing so as to reduce pipe diameter and thickness, to thereby obtain stainless steel pipes having an outside diameter of 0.953 cm, an inside diameter of 0.753 cm, a wall thickness of 0.10 cm, and a length of 400 cm. Also, after the cold reducing and cold drawing, the stainless steel pipes were heated in a pure hydrogen gas atmosphere through customary bright annealing method.

After bright annealing, the inner surfaces of the stainless steel pipes were electro-polished in a conventional manner, and smoothed so that the surface roughness became 1 $\mu$m or less in terms of Rmax. Subsequently, the stainless steel pipes were washed with ultra-pure water, and dried.

Steels A to D in Table 6 represent the ferritic stainless steels according to the present invention. Steel E represents austenitic stainless steel, and steel F represents ferritic-austenitic dual phase stainless steel. Steels E and F represent stainless steels which do not fall within the scope of the present invention.

After completion of the above-described treatment, while the oxidizing gas was fed from the rear end of each pipe, the pipe was moved in a pipe-length direction and inserted into a heating furnace, and the inner surface of the pipes were subjected to oxidation treatment. The oxidizing gas compositions and the heating conditions for the inner surface oxidation treatment were the same as those of Test No. 12 in Example 1.

TABLE 6

| | Chemical composition (wt. %) Balance: Fe and impurities | | | | | | | | | | | | | | | | | | |
|---|---|---|---|---|---|---|---|---|---|---|---|---|---|---|---|---|---|---|---|
| Steel | C | Si | Mn | P | S | Ni | Cr | Cu | Mo | W | Al | Ti | Zr | Nb | B | Ca | REM | N | O |
| A | 0.009 | 0.18 | 0.11 | 0.011 | 0.001 | 0.02 | 21.2 | 0.01 | 2.30 | 0.12 | 0.008 | — | — | — | — | — | — | 0.004 | 0.005 |
| B | 0.006 | 0.02 | 0.02 | 0.016 | 0.001 | 0.54 | 25.3 | 0.21 | 0.12 | 1.52 | 0.004 | 0.08 | 0.21 | — | — | — | — | 0.004 | 0.004 |
| C | 0.003 | 0.16 | 0.03 | 0.005 | 0.002 | 1.83 | 28.9 | 0.02 | 3.85 | — | 0.007 | — | — | — | 0.0030 | 0.004 | — | 0.005 | 0.005 |
| D | 0.007 | 0.06 | 0.04 | 0.007 | 0.001 | — | 27.1 | — | 1.21 | 2.31 | 0.002 | — | — | 0.35 | — | — | 0.005 | 0.006 | 0.004 |
| E | 0.004 | 0.08 | 0.03 | 0.016 | 0.001 | 23.6 | 23.5 | — | 1.26 | — | 0.008 | — | — | — | — | — | — | 0.016 | 0.005 |
| F | 0.008 | 0.23 | 0.05 | 0.012 | 0.002 | 6.93 | 25.9 | — | 3.02 | — | 0.009 | — | — | — | — | — | — | 0.240 | 0.007 |

Steels A through D are ferritic stainless steel, Steel E is austenitic stainless steel, and Steel F is dual phase stainless steel.
Under the heading "REM" is shown a total amount of rare earth elements.

The properties of the oxide films formed on the surface of the steel pipes through the oxidation treatment were evaluated in the same manner as in Example 1.

Briefly, 3-cm long samples were obtained from each of the test steel pipes. Portions of the test steel pipes were cut out from both ends, the center, and the regions between the center and the respective ends (total 5 portions), and then cut in half in a pipe-length direction, to thereby obtain the samples. The Cr oxide films formed on the inner surface of the samples were examined through secondary ion mass spectroscopy by $N_2^+$ ion sputtering. Specifically, secondary ion mass spectroscopy was conducted in a depth direction of the oxide film, to thereby measure the maximum amount of Cr (Cr content) based on the total amounts of the primary elements; i.e., Cr, Ni, Fe, Mo, Si, and Mn, and the thickness of the film where Cr concentration was high.

Table 7 shows the results of evaluation of the properties of the oxide films. The Cr content in Table 7 indicates the maximum amount (at. %) of Cr based on the total amount of the primary elements; i.e., Cr, Ni, Fe, Mo, Si, and Mn. Regarding the numbering of position, Position 1 represents the end from which the oxidizing gas was fed. The remaining positions are numbered from Position 2 to Position 5, in order from the gas feeding end to the opposite end.

TABLE 7

| Test No. | Steel | Cr content (wt. %) Position 1 | Position 2 | Position 3 | Position 4 | Position 5 | Film thickness (nm) Position 1 | Position 2 | Position 3 | Position 4 | Position 5 |
|---|---|---|---|---|---|---|---|---|---|---|---|
| 23 | A | 94 | 96 | 95 | 96 | 96 | 33 | 35 | 36 | 35 | 33 |
| 24 | B | 96 | 97 | 98 | 96 | 96 | 30 | 29 | 28 | 28 | 29 |
| 25 | C | 98 | 99 | 100 | 98 | 98 | 25 | 26 | 27 | 28 | 30 |
| 26 | D | 98 | 97 | 96 | 99 | 99 | 23 | 26 | 26 | 24 | 26 |
| 27 | * E | 82 | 86 | 79 | 80 | 83 | 10 | 8 | 9 | 10 | 9 |
| 28 | * F | 88 | 89 | 92 | 88 | 90 | 21 | 19 | 20 | 23 | 20 |

Data marked with * deviate the conditions defined in the present invention.

Test Nos. 23 to 26 in Table 7 represent the examples of the present invention in which the steel pipes subjected to oxidation treatment were formed of ferritic stainless steel. In these Test Nos., regardless of the size of the test pipes and the longitudinal position of the pipes, the Cr contents were in excess of 95 at. %, and uniform oxide films having a thickness of 23–36 nm were formed. In contrast, Test Nos. 27 and 28 represent comparative examples in which the steel pipes subjected to oxidation treatment were not of ferritic stainless steel. In these comparative examples, even if the conditions, including the flow rate of the oxidizing gas, the composition of the oxidizing gas (the steam content and the hydrogen content), and the heating temperature, were those specified by the present invention, in most cases the Cr content in the oxide film was less than 90%; and some of the oxide films had a thickness of less than 10 nm, depending on the position.

The metallographic microstructure of each steel pipe of the examples of the present invention from Test Nos. 23 to 26 was observed under an optical microscope, and no Cr carbides were found in the steel pipes.

INDUSTRIAL APPLICABILITY

By the oxidation treatment method according to the present invention, Cr oxide film can be formed with high efficiency on the inner surface of a ferritic stainless steel such that the film has uniform Cr content and uniform thickness along the entire length of the pipe, wherein the pipe is used as piping or a piping member for supplying ultra-pure fluid such as gas or water used in a semiconductor manufacturing process.

What is claimed is:

1. A method of oxidation treatment of the inner surface of a ferritic stainless steel pipe, comprising, feeding an oxidizing gas into steel pipe from one end thereof while moving the steel pipe in a pipe length direction; heating the pipe in a heating furnace having a non-oxidizing atmosphere at a specific temperature of T° C. which falls within the range of 700 to 1000° C. to form a Cr oxide film on the inner surface of the steel pipe; wherein the oxidizing gas refers to a mixed gas containing 10 to 99.9999 volume % hydrogen gas, 1 to 300 volume ppm steam, and the balance being an inert gas, and the non-oxidizing atmosphere refers to an atmosphere comprising 3 volume ppm or less oxygen and 30 volume ppm or less steam, or a vacuum atmosphere in which the pressure of residual gas is 5 Pa or less.

2. A method of oxidation treatment of the inner surface of a ferritic stainless steel pipe according to claim 1, wherein the oxidizing gas has a flow rate of at least Q as expressed by the following equation (i):

$$Q=\{7.24\ (DU/t)\}/C \qquad (i)$$

wherein Q represents the flow rate (liter/min) of oxidizing gas fed into a piece of stainless steel pipe; D represents the inside diameter (cm) of the steel pipe; L represents the length (cm) of a region having the temperature of T° C.±10° C. in the heating furnace; t represents the time (minutes) required for a longitudinal point on the steel pipe to pass through the above-described length L of the region having the heating temperature in the heating furnace; and C represents the concentration of steam (volume ppm) contained in the oxidizing gas.

3. A method of oxidation treatment of the inner surface of a ferritic stainless steel pipe according to claim 2, wherein the flow rate of the oxidizing gas is 3 Q or less.

4. A method of oxidation treatment of the inner surface of a ferritic stainless steel pipe according to claim 2, wherein the heating temperature is a specific temperature of T° C. which falls within the range of 750 to 1000° C.

5. A method of oxidation treatment of the inner surface of a ferritic stainless steel pipe according to claim 1, wherein the heating temperature is a specific temperature of T° C. which falls within the range of 800 to 1000° C.

6. A method of oxidation treatment of the inner surface of a ferritic stainless steel pipe according to claim 2, wherein the heating temperature is a specific temperature of T° C. which falls within the range of 800 to 1000° C.

7. A method of oxidation treatment of the inner surface of a ferritic stainless steel pipe according to claim 2, wherein the steam content in the oxidizing gas is 5 to 200 volume ppm.

8. A method of oxidation treatment of the inner surface of a ferritic stainless steel pipe according to claim 1, wherein the steam content in the oxidizing gas is 10 to 100 volume ppm.

9. A method of oxidation treatment of the inner surface of a ferritic stainless steel pipe according to claim 2, wherein the steam content in the oxidizing gas is 10 to 100 volume ppm.

10. A method of oxidation treatment of the inner surface of a ferritic stainless steel pipe according to claim 2, wherein the oxidizing gas is fed at a pressure of 0.2 kgf/cm$^2$ or over.

11. A method of oxidation treatment of the inner surface of a ferritic stainless steel pipe according to claim 1, wherein the oxidizing gas is fed at a pressure of 0.5 kgf/cm$^2$ or over.

12. A method of oxidation treatment of the inner surface of a ferritic stainless steel pipe according to claim 2, wherein the oxidizing gas is fed at a pressure of 0.5 kgf/cm$^2$ or over.

13. A method of oxidation treatment of the inner surface of a ferritic stainless steel pipe according to claim 1, further comprising providing a member having an orifice with an inner diameter of less than 10 mm at a pipe end opposite the side to which the oxidizing gas is fed.

14. A method of oxidation treatment of the inner surface of a ferritic stainless steel pipe according to claim 2, further comprising providing a member having an orifice with an inner diameter of less than 10 mm at a pipe end opposite the side to which the oxidizing gas is fed.

15. A method of oxidation treatment of the inner surface of a ferritic stainless steel pipe according to claim 1, further comprising attaching a dummy steel pipe to both ends of the steel pipe to be treated.

16. A method of oxidation treatment of the inner surface of a ferritic stainless steel pipe according to claim 2, further comprising attaching a dummy steel pipe to both ends of the steel pipe to be treated.

17. A method of oxidation treatment of the inner surface of a ferritic stainless steel pipe according to claim 1, further comprising connecting a plurality of steel pipes to be treated in a pipe-length direction, to thereby perform the treatment in a continuous manner.

18. A method of oxidation treatment of the inner surface of a ferritic stainless steel pipe according to claim 2, further comprising connecting a plurality of steel pipes to be treated in a pipe-length direction, to thereby perform the treatment in a continuous manner.

19. A method of oxidation treatment of the inner surface of a ferritic stainless steel pipe according to claim 1, wherein the stainless steel contains, by weight, up to 0.03% carbon, up to, 0.5% silicon, up to 0.2% manganese, up to 5% nickel, 20 to 30% chromium, and 0.1 to 5% molybdenum, and the balance iron and unavoidable impurities containing up to 0.03% nitrogen, up to 0.03% phosphorous, up to 0.003% sulfur, and up to 0.01% oxygen.

20. A method of oxidation treatment of the inner surface of a ferritic stainless steel pipe according to claim 2, wherein the stainless steel contains, by weight, up to 0.03% carbon, up to 0.5% silicon, up to 0.2% manganese, up to 5% nickel, 20 to 30% chromium, and 0.1 to 5% molybdenum, and the balance iron and unavoidable impurities containing up to 0.03% nitrogen, up to 0.03% phosphorous, up to 0.003% sulfur, and up to 0.01% oxygen.

21. The method of claim 19, further comprising up to 1% copper, up to 5% tungsten, up to 0.05% aluminum, up to 1% titanium, up to 1% zirconium, up to 1% niobium, up to 0.01% boron, up to 0.01% calcium, up to 0.01% magnesium, and up to 0.01% in total rare earth elements.

22. The method of claim 20, further comprising up to 1% copper, up to 5% tungsten, up to 0.05% aluminum, up to 1% titanium, up to 1% zirconium, up to 1% niobium, up to 0.01% boron, up to 0.01% calcium, up to 0.01% magnesium, and up to 0.01% in total rare earth elements.

* * * * *

UNITED STATES PATENT AND TRADEMARK OFFICE

CERTIFICATE OF CORRECTION

PATENT NO. : 6,231,690 B1
DATED : May 15, 2001
INVENTOR(S) : Azuma

It is certified that error appears in the above-identified patent and that said Letters Patent is hereby corrected as shown below:

Title page,
Should read "METHOD OF OXIDIZING INNER SURFACE OF FERRITIC STAINLESS STEEL PIPE"

Attorney, Agent or Firm is: Clark & Brody

Signed and Sealed this

Eleventh Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,231,690 B1
DATED : May 15, 2001
INVENTOR(S) : Azuma

It is certified that error appears in the above-identified patent and that said Letters Patent is hereby corrected as shown below:

Title page,
Insert the following,
-- Assignee is: SUMITOMO METAL INDUSTRIES, LTD.
OSAKA, JAPAN --

Signed and Sealed this

Twenty-second Day of January, 2002

*Attest:*

*Attesting Officer*

JAMES E. ROGAN
*Director of the United States Patent and Trademark Office*